US009873133B2

(12) United States Patent
Hsu et al.

(10) Patent No.: US 9,873,133 B2
(45) Date of Patent: Jan. 23, 2018

(54) EXTRUSION DEVICE AND COATING SYSTEM

(71) Applicant: Creating Nano Technologies, Inc., Tainan (TW)

(72) Inventors: Yi-Ming Hsu, Tainan (TW); Yen-Ling Liu, Tainan (TW); Li-Min Wang, Tainan (TW); Chien-Cheng Wang, Tainan (TW); Wen-Hsiao Shen, Tainan (TW)

(73) Assignee: Creating Nano Technologies, Inc., Tainan (TW)

( * ) Notice: Subject to any disclaimer, the term of this patent is extended or adjusted under 35 U.S.C. 154(b) by 571 days.

(21) Appl. No.: 14/509,054

(22) Filed: Oct. 8, 2014

(65) Prior Publication Data

US 2015/0360251 A1 Dec. 17, 2015

(30) Foreign Application Priority Data

Jun. 13, 2014 (TW) ..... 103120563 A

(51) Int. Cl.

| | |
|---|---|
| ***B01F 5/10*** | (2006.01) |
| ***B05B 15/00*** | (2006.01) |
| ***B01F 15/00*** | (2006.01) |
| ***B01F 15/04*** | (2006.01) |

(52) U.S. Cl.

CPC ..... *B05B 15/002* (2013.01); *B01F 5/106* (2013.01); *B01F 15/00155* (2013.01); *B01F 15/0462* (2013.01); *B01F 15/0475* (2013.01)

(58) Field of Classification Search

CPC ..... B01F 5/106

USPC ..... 366/136, 137

See application file for complete search history.

(56) References Cited

U.S. PATENT DOCUMENTS

| | | | | |
|---|---|---|---|---|
| 134,100 A * | 12/1872 | Rengel | B01F 5/10 | 366/137 |
| 2,266,126 A * | 12/1941 | Malsbary et al. | B60S 3/044 | 134/94.1 |
| 2,877,929 A * | 3/1959 | Ireland | B01J 4/02 | 137/563 |
| 2,927,006 A * | 3/1960 | Brooks | C08F 10/00 | 366/136 |

(Continued)

FOREIGN PATENT DOCUMENTS

| | | |
|---|---|---|
| CN | 103145344 | 6/2013 |
| JP | 2011101851 | 5/2011 |

(Continued)

OTHER PUBLICATIONS

"Office Action of Taiwan Counterpart Application" , dated May 26, 2015, p. 1-p. 6.

*Primary Examiner* — David Sorkin
(74) *Attorney, Agent, or Firm* — JCIPRNET

(57) ABSTRACT

An extrusion device includes a container, a pump, a plurality of pipes, and an adjustment device. The container has a chamber, and a first inlet/outlet and a second inlet/outlet connected to the chamber, wherein the chamber is adapted to contain a fluid inside. The pipes are connected between the pump and the first and second inlet/outlets of the container, so as to form a fluid loop. The pump is adapted to drive the fluid to flow inside the fluid loop. The adjustment device is coupled to the container for adjusting a volume of the chamber. Further, a coating system is also provided.

10 Claims, 2 Drawing Sheets

(56) References Cited

U.S. PATENT DOCUMENTS

| | | | | |
|---|---|---|---|---|
| 4,379,122 | A * | 4/1983 | Taubenmann | B29B 7/7673 137/625.4 |
| 4,565,511 | A * | 1/1986 | Ramisch | B29B 7/7626 137/98 |
| 4,857,241 | A * | 8/1989 | Straw | B01F 5/106 261/152 |
| 7,736,591 | B2 | 6/2010 | Rose et al. | |
| 8,628,723 | B2 | 1/2014 | Vandergaw | |

FOREIGN PATENT DOCUMENTS

| | | |
|---|---|---|
| TW | I396593 | 5/2013 |
| TW | 201334875 | 9/2013 |

* cited by examiner

EXTRUSION DEVICE AND COATING SYSTEM

CROSS-REFERENCE TO RELATED APPLICATION

This application claims the priority benefit of Taiwan application serial no. 103120563, filed on Jun. 13, 2014. The entirety of the above-mentioned patent application is hereby incorporated by reference herein and made a part of this specification.

FIELD OF THE INVENTION

The disclosure relates to an extrusion device and a coating system; more particularly, the disclosure relates to a quantitative and circulatory extrusion system, which is used particularly for quantitatively controlling a liquid solution that contains particles or is easy to be deposited or layered after standing for a long time in a coating system.

DESCRIPTION OF RELATED ART

Currently, various kinds of spraying systems are greatly adopted in different types of thin-film manufacturing process. However, in the various kinds of spraying systems currently adopted in the market, the issue most commonly seen is poor evenness presented in discharges from a solution containing suspended particles. Particularly, the spraying system currently adopted in the market is gradually applied on techniques of processing optical films and other ultra-thin films. Accordingly, standards for controlling flow amounts and desired flow amounts of a liquid solution delivery system have become more stringent. In addition, a coating process is only processed after a liquid solution having fine particles, such as a fluorescent paint and a colored paint, is mixed by blending or by an internal circulation. However, the following defect still exists regardless of applications of a blending drum or an internal circulation. For example, an issue of deposition and layering has existing in a process of delivering a liquid solution which is blended and mixed evenly to an exit. Besides, considerations cannot be given to functions of accurately measuring and monitoring amounts of the liquid solution which is discharged from the exit when the internal circulation device is applied.

SUMMARY

The disclosure provides an extrusion device, which contains components and structures for quantitative extrusion and internal circulation, and is configured for extruding a fluid quantitatively and has functions of circulating and blending the fluid.

The disclosure provides a coating system having the aforementioned extrusion device for quantitatively spraying a fluid on a target workpiece.

An embodiment of the disclosure provides an extrusion device including a container, a pump, a plurality of pipes, and an adjustment device. The container has a chamber, and a first inlet/outlet and a second inlet/outlet connected to the chamber, wherein the chamber is adapted to contain a fluid. The plurality of pipes are connected between the pump and the first and second inlet/outlets of the container, so as to form a fluid loop. The pump is adapted to drive the fluid to flow inside the fluid loop. The adjustment device is coupled to the container for adjusting a volume of the chamber.

An embodiment of the disclosure provides a coating system, which includes a container, a pump, a nozzle, a plurality of pipes, and an adjustment device. The container has a chamber, and a first inlet/outlet and a second inlet/outlet connected to the chamber, wherein the chamber is adapted to contain a fluid. The plurality of pipes are connected among the pump, the nozzle, the first inlet/outlet, and second inlet/outlet of the container, so as to form a fluid loop. The pump is adapted to drive the fluid to flow inside the fluid loop. The adjustment device coupled to the container is adapted to adjust a volume of the chamber to eject the fluid from the nozzle.

In view of the above, the extrusion device of the disclosure contains a container having volumes to be changeable, and is adapted to contain a liquid. The container has a chamber and at least two or more inlet/outlets connecting to the chamber, wherein pipes and a pump are connected to the plurality of inlet/outlets to form a fluid loop. The extrusion device includes an adjustment device which is capable of adjusting volumes of the chamber, so as to push out the fluid quantitatively.

In addition, the container of the disclosure may include an outer feeder and a push rod. The push rod has a channel and a second inlet/outlet. The second inlet/outlet is connected to the chamber via the channel, and the second inlet/outlet may also be connected to the pipes which deliver the fluid. Accordingly, in the disclosure, the container and the pump may form a fluid circulation loop via the plurality of pipes. The fluid may enter the container via the channel of the push rod. The fluid, such as a liquid solution is extruded from the inlet/outlets of the container quantitatively and delivered in a circulated manner through the pipes by pushing the push rod in the outer feeder, and being pumped by the pumping force (extracting force and pushing force) from the pump. On another aspect, the extrusion device of the disclosure may also be connected to a nozzle via the delivery pipes to form a coating system. By controlling the adjustment device, the extrusion device is driven to extrude the fluid quantitatively and then the fluid can be ejected from the nozzle via the pipes, while another portion of the fluid is returned to the container by the pumping force. Thus, the fluid can be circulated and blended to avoid particles in the fluid from being deposited or layered. In summary, the coating system of the disclosure can provide quantitative extrusion by the extrusion device, and have the function of circulation and blending for preventing deposition or layering of the fluid.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
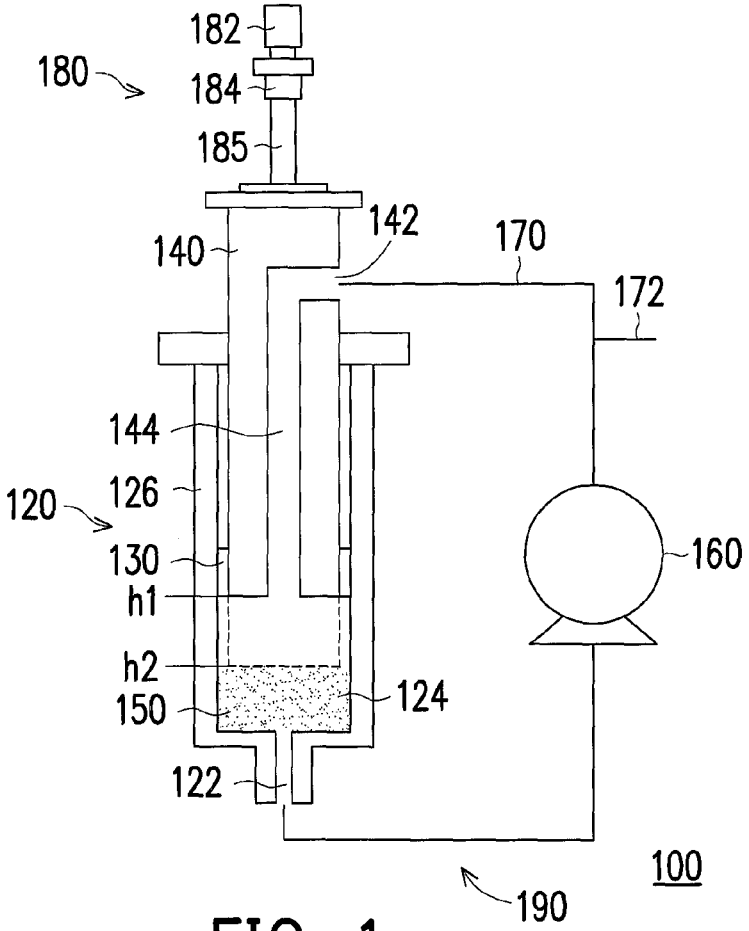
FIG. 1 is a schematic view illustrating an extrusion device according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is a schematic view illustrating an extrusion device according to an embodiment of the disclosure. With reference to FIG. 1, an extrusion device 100 includes a container 120, a pump 160, a plurality of pipes 170, and an adjustment device 180. The container 120 has a chamber 124, and a first inlet/outlet 122 and a second inlet/outlet 142 connecting to the chamber 124. The chamber 124 contains a fluid 150, for example, a liquid solution. The plurality of pipes 170 are connected between the pump 160 and the first and second inlet/outlets 122 and 142 of the container 120 to form a fluid loop 190. In addition, the pump 160 is adapted to drive the fluid 150 flowing inside the fluid loop 190. The adjustment device 180 is coupled to the container 120 for adjusting a volume of the chamber 124.

In the present embodiment, the container 120 of the extrusion device 100, for example, is an injection pump, which has an outer feeder 126 and a push rod 140 provided with a piston 130 disposed thereon. The outer feeder 126 has the first inlet/outlet 122 for extruding the fluid 150 from the container 120 to the fluid loop 190. The push rod 140 is slidably disposed inside the chamber 124, and a size of the volume of the chamber 124 is defined by the outer feeder 126 and the push rod 140 together, such that the size of the volume of the chamber 124 can be changed by the adjustment device 180 when driving push rod 140 to move in relative to the outer feeder 126. Specifically, referring to FIG. 1, the adjustment device 180 may drive the push rod 140 to move from a first height h1 to a second height h2 along a perpendicular direction in the outer feeder 126 to change the volume of the chamber 124. Furthermore, the push rod 140 of the present embodiment may include a channel 144 and a second inlet/outlet 142, wherein the channel 144 penetrates the push rod 140. Through the channel 144, the chamber 124 is connected to the second inlet/outlet 142 and to the pipes 170 delivering the fluid 150. In other words, with the above arrangements, the fluid 150 may flow into the chamber 124 through the second inlet/outlet 142 and the channel 144. And then, the fluid 150 can be extruded from the first inlet/outlet 122 when the volume and pressure inside the chamber 124 are changed by driving the push rod 140 to move in relative to the outer feeder 126. Particularly, in the present embodiment, the extrusion device 100 of the disclosure may have at least two or more inlet/outlets. In addition to allow the fluid 150 held inside the chamber 124 to flow through the first inlet/outlet 122 on the outer feeder 126 and eventually flow out from an outflow port 172, a portion of the fluid 150 returns back to the chamber 124 through the formed fluid loop 190, the second inlet/outlet 142 and the channel 144 on the push rod 140.

Figure 2:
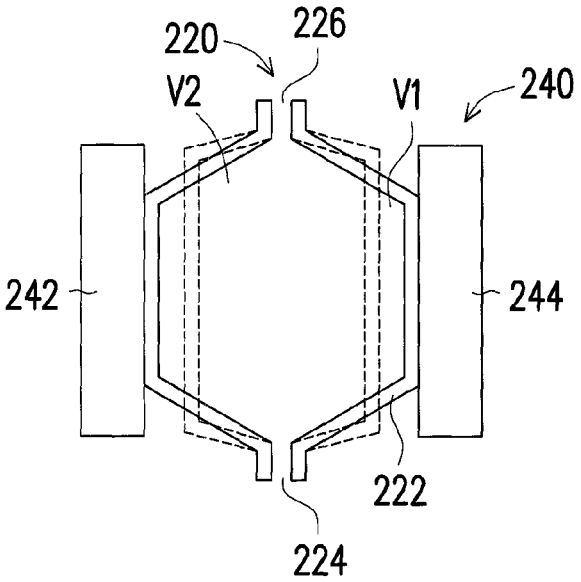
FIG. 2 is a schematic view illustrating an extrusion device according to another embodiment of the disclosure.

In the previous embodiment of the disclosure, the extrusion device 100 is illustrated by taking an injection pump as an example, but the disclosure is not limited thereto. FIG. 2 is a schematic view illustrating an extrusion device according to another embodiment of the disclosure. With reference to FIG. 2, the extrusion device adopts a flexible container 220 such as a ball pump. A body of the elastic container 220 is elastic, and an adjustment device 240 can be disposed on an outer wall 222 of the flexible container 220. The adjustment device 240 of the present embodiment may include two pushing elements 242 and 244. The two pushing elements 242 and 244 respectively prop against the outer wall 222 of the body of the elastic container 220, and can be move with respect to each other. The relative movement between the pushing elements 242 and 244 deforms the body of the flexible container 220, such that the volume within the flexible container 220 can changed from an uncompressed volume V1 to a volume V2. With the changes of the volume in the elastic container 220, pressures within the elastic container 220 changes as well, and the fluid (as shown in FIG. 1) flowing into the elastic container 220 through the second inlet/outlet 226 can be extruded out from the first inlet/outlet 224.

With reference to FIG. 1 again, the adjustment device 180 of the present embodiment may include a driving device 182 and a transmission element 184, wherein the transmission element 184 is coupled between the driving device 182 and the push rod 140 to drive the push rod 140 moving in relative to the outer feeder 126. In addition, the transmission element 184 of the present embodiment includes a screw 185, which drives the push rod 140 to move back and forth along an axial direction of the screw 185. Furthermore, the driving device 182 may control a speed of the transmission element 184 for pushing the push rod 140. Accordingly, the push rod can be controlled and driven by the driving device 182 to move toward the first inlet/outlet 122 of the container 120 at a constant speed, such that the volume of the chamber 124 is reduced at the constant speed, and the fluid 150 inside the chamber 124 can be extruded quantitatively.

Figure 3:
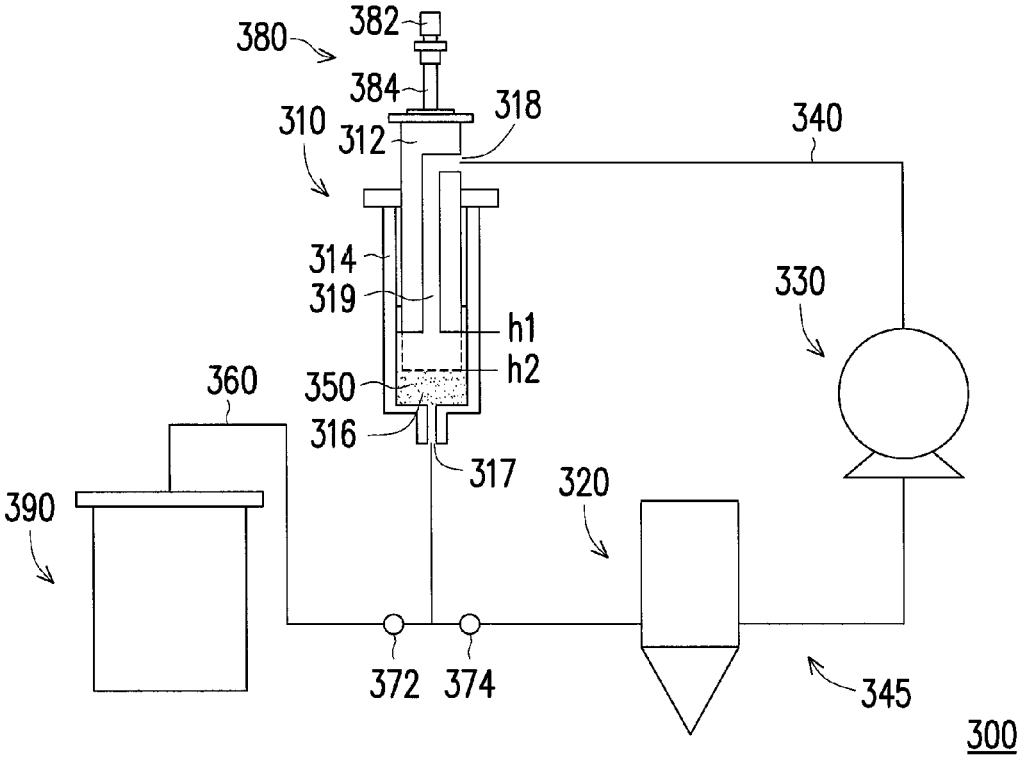
FIG. 3 is a schematic view illustrating a coating system according to an embodiment of the disclosure.

FIG. 3 is a schematic view illustrating a coating system according to an embodiment of the disclosure. A coating system 300 includes a container 310, a nozzle 320, a pump 330, a plurality of pipes 340, and an adjustment device 380. The container 310 of the present embodiment has a chamber 316, and a first inlet/outlet 317 and a second inlet/outlet 318 connected to the chamber 316, wherein the chamber 316 contains a fluid 350, for example, a liquid solution. The plurality of pipes 340 are respectively connected among the pump 330, the nozzle 320, the first inlet/outlet 317, and the second inlet/outlet 318 of the container 310 to form a fluid loop 345. In addition, the pump 330 is adapted to drive the fluid 350 to flow inside the fluid loop 345. The adjustment device 380 is coupled to the container 310 for adjusting a volume of the chamber 316, such that the fluid 350 is extruded from the first inlet/outlet 317 before being ejected from the nozzle 320. In the present embodiment, the aforementioned extrusion device 100 is applied on the coating system 300, such that, for example, the fluid 350 of the liquid solution may be quantitatively delivered into the fluid loop 345 by actions of the adjustment device 380 and the pump 330, and then be ejected from the nozzle 320 and coated onto a target workpiece (not shown).

The container 310 of the present embodiment includes a push rod 312 and an outer feeder 314. The fluid 350 contained by the container 310 may flow out through the first inlet/outlet 317 of the outer feeder 314. And, the fluid 350 driven by the pump 330 returns back to the chamber 316 through the fluid loop 345 formed of the plurality of the components, the second inlet/outlet 318 of the push rod 312, and a channel 319. Accordingly, in a coating process of the disclosure, the fluid 350 flowing through the pipe 340 connected to the nozzle 320 but not ejected by the nozzle 320 is driving by the pump 330 and returns back to the chamber 316 of the container 310 in circulation manner. Since the unused fluid 350 returns back to the chamber 316 of the container 310 in circulation manner, the fluid 350 (e.g. liquid solution) can be prevented from being deposited and layered. Furthermore, the adjustment device 380 comprising a driving device 382 and a transmission element 384 (e.g. a screw) drives the push rod 312 to move at a constant speed in the outer feeder 314 from, for example, the first height h1 to the second height h2 in a vertical direction, so as to change the volume of the chamber 316. When the volume of the chamber 316 is changed at the constant speed by the push rod 312, the fluid 350 in the container 310 is extruded to the nozzle 320 at the constant speed to perform a coating process. Accordingly, amounts of the fluid 350 ejected from the nozzle 320 within a specific time period can be controlled, such that coating on each part of the coated workpiece is uniform and precise. Moreover, the nozzle 320 in the present embodiment may be, such as, but not limited to, a single fluid nozzle, a two stream nozzle, an ultrasonic nozzle, a slit die nozzle, a piezo nozzle, or a thermo-compression nozzle and so on.

The coating system 300 of the present embodiment may further include a liquid solution feeder 390 and a liquid supply pipe 360 connected to the liquid solution feeder 390. The liquid solution feeder 390 delivers the fluid 350 to the fluid loop 345 via the liquid supply pipe 360. In addition, an on-off valve 372 for extraction may be arranged between the liquid solution feeder 390 and the fluid loop 345 for controlling open and close of the liquid supply pipe 360. Furthermore, the liquid solution feeder 390 of the present embodiment may further include a blender (not shown) for properly and evenly blend a liquid solution, so as to prevent the liquid solution from be deposited and layered due to difference of density among components of the liquid solution. On another aspect, a blending speed or a blending manner of the blender may be adjusted and varied along with varieties or viscosity of the liquid solution.

With reference to FIG. 3 again, the coating system of the disclosure may further include a sensor (not shown). For example, a fluid level sensor is arranged inside or outside the container 310 for detecting a liquid level of the fluid 350 inside the container 310. In addition, the on-off valve for extraction 372 may be arranged between the first inlet/outlet 317 of the container 310 and the liquid solution feeder 390. Meanwhile, an on-off valve for spraying 374 may be arranged between the first inlet/outlet 317 of the container 310 and the nozzle 320. When the level of the fluid 350 in the container 310 is too low, the on-off valve for extraction 372 may be activated manually or by transmitting a detection signal to the on-off valve 372. Then, the volume of the chamber 316 is further changed by the adjustment device 380, i.e., the push rod 312 is pushed back to the first height h1 from the second height h2 in a vertical direction by a driving of the driving device 382. Pressure changing inside the container 310 allows the fluid 350 of the liquid solution feeder 390 to be extracted to the chamber 316 of the container 310 via the first inlet/outlet 317. At the same time, the on-off valve for spraying 374 between the first inlet/outlet 317 of the container 310 and the nozzle 320 is turned off, so as to prevent the fluid 350 from the liquid solution feeder 390 flows directly into the fluid loop 345 and also flows to the nozzle 320. On another aspect, the on-off valve for spraying 374 may be turned on when delivering the fluid 350 in the container 310 to the nozzle 320, and the on-off valve for extraction 372 may be turned off at the same time to prevent the fluid 350 flowing out of the first inlet/outlet 317 of the container 310 from flowing back to the liquid solution feeder 390 via the on-off valve for extraction 372.

Figure 4:
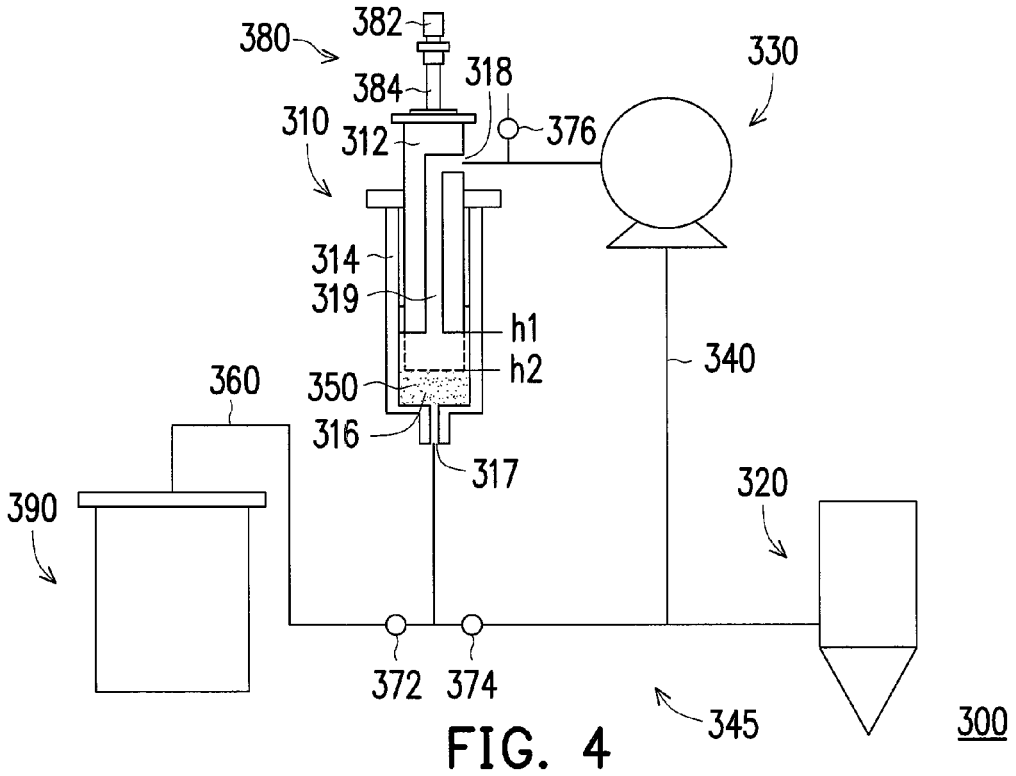
FIG. 4 is a schematic view illustrating a coating system according to another embodiment of the disclosure.

FIG. 4 is a schematic view illustrating a coating system according to another embodiment of the disclosure. In the present embodiment, an exhaust device 376, such as an exhaustion valve, may further be included on the fluid loop 345 of the coating system 300 for exhausting air inside the fluid loop 345 and adjusting pressures inside the fluid loop 345. In the present embodiment, the exhaustion device 376 may further be arranged in coordination with an air detector (not shown) inside the fluid loop 345 to detect whether air is present inside the fluid loop 345, and then adjust and turn the exhaustion device 376 on or off.

In summary, the disclosure discloses an extrusion device and a coating system containing the extrusion device. The extrusion device includes a first inlet/outlet and a second inlet/outlet, and may contain a fluid inside a container of the extrusion device, wherein the first inlet/outlet is adapted to allow the fluid inside the container to flow out, and the second inlet/outlet is adapted to allow the fluid circulated inside a fluid loop to flow back to the container via the second inlet/outlet. In addition, the container disclosed in the disclosure has a chamber, and a size of the chamber may be changed by adjusting an adjustment device. The adjustment device may change the size of the chamber for a fixed quantity at a constant speed, and at the same time, quantitative extrusion and quantitative supplying of the liquid solution in a process may be achieved with changes of volume inside the chamber. Furthermore, components of the coating system of the present embodiment includes the container, a nozzle and a pump, and so on, for connecting and forming a circulated fluid loop, such that an unused liquid solution passing through the nozzle and pipes in a coating process may quickly be circulated back to the container by a driving of dynamic force of the pump and delivering pipes to avoid generations of deposition or layering due to unevenness of the liquid solution in the process. On another aspect, the coating system of the disclosure further includes a liquid solution feeder and a liquid supply pipe, such that the coating system may supply the liquid solution from the liquid solution feeder to the container with a level change of the fluid in the container. Moreover, the liquid solution feeder of the disclosure may further include a blending device for blending a liquid solution with a proper blending speed and method so as to prevent the liquid solution from deposition and layering due to different component densities and uneven distributions of the liquid solution. Accordingly, the coating process presents more even spraying effects and quality thereof is further improved.

Although the disclosure has been disclosed with reference to the aforesaid embodiments, they are not intended to limit the disclosure. It will be apparent to those skilled in the art that various modifications and variations can be made to the structure of the disclosed embodiments without departing from the scope or spirit of the disclosure. In view of the foregoing, it is intended that the disclosure cover modifications and variations of the specification provided they fall within the scope of the following claims and their equivalents.

What is claimed is:

1. An extrusion device, comprising:

a container having a chamber, and a first inlet/outlet and a second inlet/outlet connected to the chamber, wherein the chamber is adapted to contain a fluid inside;

a pump;

a plurality of pipes connected between the pump and the first inlet/outlet and second inlet/outlet of the container to form a fluid loop, the pump is configured to drive the fluid to flow inside the fluid loop;

an adjustment device coupled to the container for adjusting a volume of the chamber;

an outer feeder having the first inlet/outlet; and a push rod slidably disposed within the chamber, the outer feeder and the push rod together defining the chamber to change the volume of the chamber by the adjustment device for driving the outer feeder and the push rod to move relatively, and the push rod having a channel and the second inlet/outlet, wherein the channel passes through the push rod, and the second inlet/outlet is connected to the chamber via the channel, the adjustment device comprises a driving device and a transmission element, the transmission element is coupled between the driving device and the push rod to move the push rod relative to the outer feeder, wherein the fluid flowed inside the fluid loop and the push rod moved to extrude the fluid from the first inlet/outlet at a constant amount.

2. The extrusion device as claimed in claim 1, wherein the transmission element comprises a screw, and the push rod is adapted to move along an axial direction of the screw.

3. A coating system, comprising:

a container having a chamber, and a first inlet/outlet and a second inlet/outlet connected to the chamber, wherein the chamber is adapted to contain a fluid inside;

a pump;

a nozzle;

a plurality of pipes connected among the pump, the nozzle, and the first inlet/outlet and second inlet/outlet of the container to form a fluid loop, the pump adapted to drive the fluid to flow inside the fluid loop;

an adjustment device coupled to the container and adapted is configured to adjust a volume of the chamber;

an outer feeder having the first inlet/outlet; and a push rod slidably disposed within the chamber, the outer feeder and the push rod together defining the chamber to change the volume of the chamber by the adjustment device for driving the outer feeder and the push rod to move relatively, and the push rod having a channel and the second inlet/outlet, wherein the channel passes through the push rod, and the second inlet/outlet is connected to the chamber via the channel, the adjustment device comprises a driving device and a transmission element, the transmission element is coupled between the driving device and the push rod to move the push rod relative to the outer feeder, wherein the fluid flowed inside the fluid loop and the push rod moved to extrude the fluid from the first inlet/outlet and to eject the fluid from the nozzle at a constant amount.

4. The coating system as claimed in claim 3, wherein the transmission element comprises a screw, and the push rod is adapted to move along an axial direction of the screw.

5. The coating system as claimed in claim 3, further comprising a liquid solution feeder and a liquid supply pipe, the liquid solution feeder configured for containing the liquid, the liquid supply pipe connecting the liquid solution feeder to the fluid loop, such that the fluid is delivered to the fluid loop through the liquid supply pipe.

6. The coating system as claimed in claim 5, wherein the liquid solution feeder comprises a blending device disposed within the liquid solution feeder.

7. The coating system as claimed in claim 3, wherein the nozzle is a single fluid nozzle, a two stream nozzle, an ultrasonic nozzle, a slide die nozzle, a piezo nozzle, or a thermo-compression nozzle.

8. The coating system as claimed in claim 3, further comprising at least a sensor disposed inside or outside the chamber and configured for monitoring volume changes of the chamber.

9. The coating system as claimed in claim 3, further comprising a plurality of valves disposed respectively at the fluid loop and the liquid supply pipe to respectively control on or off of the fluid loop and the liquid supply pipe.

10. The coating system as claimed in claim 3, further comprising an exhaust device disposed at the fluid loop and configured for exhausting air inside the fluid loop.

* * * * *